US007789996B2

(12) United States Patent
Buzza et al.

(10) Patent No.: US 7,789,996 B2
(45) Date of Patent: Sep. 7, 2010

(54) PAPER SUBSTRATES USEFUL IN WALLBOARD TAPE APPLICATIONS

(75) Inventors: Stephen A Buzza, Ovilla, TX (US); Dennis W. Anderson, Goshen, OH (US); Yufeng Xu, Loveland, OH (US); Bruce Richard McGaffin, Middletown, OH (US); Christopher Michael Wilson, Middletown, OH (US)

(73) Assignee: International Paper Company, Memphis, TN (US)

( * ) Notice: Subject to any disclaimer, the term of this patent is extended or adjusted under 35 U.S.C. 154(b) by 791 days.

(21) Appl. No.: 11/352,941

(22) Filed: Feb. 13, 2006

(65) Prior Publication Data

US 2006/0191656 A1 Aug. 31, 2006

Related U.S. Application Data

(60) Provisional application No. 60/652,097, filed on Feb. 11, 2005.

(51) Int. Cl.
*D21H 27/18* (2006.01)
*D21H 21/14* (2006.01)
*D21H 21/16* (2006.01)
*D21H 21/20* (2006.01)

(52) U.S. Cl. ..... 162/158; 162/168.1; 162/175; 162/177; 162/181.2; 428/537.5

(58) Field of Classification Search ..... 162/109, 162/141, 158, 164.1, 164.3, 164.6, 168.1, 162/168.3, 179, 181.1, 181.2, 175, 178; 428/156, 688, 221, 537.5; 156/39
See application file for complete search history.

(56) References Cited

U.S. PATENT DOCUMENTS 2,667,822 A * 2/1954 Christman ..... 264/156
3,392,085 A * 7/1968 Oliver ..... 162/175
3,630,830 A * 12/1971 Herdle et al. ..... 162/135
4,022,965 A 5/1977 Goheen et al.
4,041,202 A * 8/1977 Williams ..... 428/138
4,075,136 A 2/1978 Schaper
4,166,894 A 9/1979 Schaper
4,174,417 A 11/1979 Rydell
4,184,914 A 1/1980 Jenkins
4,372,814 A * 2/1983 Johnstone et al. ..... 162/124
4,431,481 A 2/1984 Drach et al.
4,448,639 A * 5/1984 Long ..... 162/124
4,496,427 A 1/1985 Davison
4,548,676 A * 10/1985 Johnstone et al. ..... 162/135
4,665,014 A * 5/1987 Katsura ..... 430/538
4,710,422 A 12/1987 Fredenucci
4,792,473 A * 12/1988 Vitale ..... 428/41.8
4,853,085 A * 8/1989 Johnstone et al. ..... 162/128
4,986,882 A 1/1991 Mackey et al.
5,011,741 A 4/1991 Hoffman
5,049,235 A 9/1991 Baracus et al.
5,160,789 A 11/1992 Barcus et al.
5,209,953 A 5/1993 Grupe et al.
5,266,250 A 11/1993 Kroyer
5,360,420 A 11/1994 Cook et al.
5,443,899 A 8/1995 Barcus et al.
5,527,430 A 6/1996 Gill
5,531,728 A 7/1996 Lash
5,585,456 A * 12/1996 Dulany et al. ..... 528/332
5,613,335 A * 3/1997 Rennich et al. ..... 52/255
5,662,773 A 9/1997 Frederick et al.
5,667,637 A 9/1997 Jewell et al.
5,685,815 A 11/1997 Bottorff et al.
5,698,074 A 12/1997 Barcus et al.
5,698,688 A 12/1997 Smith et al.
5,711,124 A * 1/1998 Stough et al. ..... 52/417
5,766,417 A 6/1998 Brungardt
5,836,122 A * 11/1998 Rennich et al. ..... 52/254
6,033,526 A 3/2000 Ehrhardt et al.
6,077,906 A 6/2000 Thiruvengada et al.
6,126,783 A 10/2000 Gill
6,133,170 A 10/2000 Suenaga
6,146,494 A 11/2000 Seger et al.
6,165,321 A 12/2000 Pauley et al.
6,171,440 B1 1/2001 Staib
6,228,219 B1 5/2001 Ehrhardt et al.
6,273,997 B1 8/2001 Ehrhardt et al.
6,306,255 B1 * 10/2001 Frolich et al. ..... 162/158
6,316,095 B1 11/2001 Black et al.

(Continued)

FOREIGN PATENT DOCUMENTS

CA 2508688 A1 * 9/2006

(Continued)

OTHER PUBLICATIONS

G. A. Smook, "Handbook for Pulp & Papper Technologists," 1992, Angus wilde Publications, 2nd edition, pp. 220-227.*

*Primary Examiner*—José A Fortuna
(74) *Attorney, Agent, or Firm*—Thomas W. Barnes, III; Eric W. Guttag

(57) ABSTRACT

This invention relates to paper products and/or substrates suitable for being made and/or converted into wallboard tape; which also may be known as joint tape and/or drywall tape, having a pH of at least 7.0 and containing a plurality of cellulose fibers, a wet strength additive, an alkaline sizing agent, and an anionic promoter, as well as methods of making and using the same.

22 Claims, 1 Drawing Sheet

U.S. PATENT DOCUMENTS

| | | | | |
|---|---|---|---|---|
| 6,355,137 | B1 | 3/2002 | Staib | |
| 6,361,651 | B1 | 3/2002 | Sun | |
| 6,471,824 | B1 | 10/2002 | Jewell | |
| 6,506,282 | B2 | 1/2003 | Hu et al. | |
| 6,512,146 | B2 | 1/2003 | Pauley et al. | |
| 6,579,414 | B2 | 6/2003 | Jewell | |
| 6,579,415 | B2 | 6/2003 | Jewell | |
| 6,582,557 | B2 | 6/2003 | Jewell | |
| 6,592,717 | B2 | 7/2003 | Jewell | |
| 6,595,632 | B1 | 7/2003 | Storfer-Isser et al. | |
| 6,869,471 | B2 * | 3/2005 | Odberg et al. | 106/287.24 |
| 7,214,434 | B2 * | 5/2007 | Dalgleish et al. | 428/537.5 |
| 2002/0062938 | A1 * | 5/2002 | Westman et al. | 162/206 |
| 2002/0142136 | A1 * | 10/2002 | Harel | 428/174 |
| 2003/0213196 | A1 * | 11/2003 | Harel | 52/287.1 |
| 2004/0206467 | A1 * | 10/2004 | Lindgren et al. | 162/158 |
| 2004/0226675 | A1 * | 11/2004 | Malmstrom et al. | 162/158 |
| 2005/0155731 | A1 * | 7/2005 | Martin et al. | 162/158 |
| 2006/0191656 | A1 * | 8/2006 | Buzza et al. | 162/158 |
| 2006/0254170 | A1 * | 11/2006 | Goldman | 52/366 |
| 2008/0128070 | A1 * | 6/2008 | Goldman | 156/71 |
| 2008/0254317 | A1 * | 10/2008 | Xu et al. | 428/688 |
| 2008/0256886 | A1 * | 10/2008 | Goldman | 52/366 |

FOREIGN PATENT DOCUMENTS

| | | | |
|---|---|---|---|
| EP | 0540076 | | 1/2001 |
| EP | 1308558 | A2 * | 5/2003 |
| EP | 1632604 | A1 * | 3/2006 |
| JP | 07070992 | A * | 3/1995 |
| WO | WO01/49938 | | 7/2001 |
| WO | WO 2005042843 | A1 * | 5/2005 |
| WO | WO 2006050848 | A1 * | 5/2006 |
| WO | WO 2006086736 | A2 * | 8/2006 |
| WO | WO 2008066488 | A1 * | 6/2008 |

* cited by examiner

PAPER SUBSTRATES USEFUL IN WALLBOARD TAPE APPLICATIONS

The present application claims the benefit of priority under 35 USC §119(e) to U.S. Provisional Patent Application 60/652,097, entitled "PAPER SUBSTRATES USEFUL IN WALLBOARD TAPE APPLICATIONS", filed Feb. 11, 2005, which is hereby incorporated, in its entirety, herein by reference.

FIELD OF THE INVENTION

This invention relates to paper products and/or substrates suitable for being made into wallboard tape (also may be known as joint tape and/or drywall tape) having a pH of at least 7.0 and containing a plurality of cellulose fibers, a wet strength additive, an alkaline sizing agent, and optionally an anionic promoter therein and/or on at least one surface of the tape and/or applied onto at least one surface and dispersed in the tape. The paper substrate is characterized by its excellent physical properties including cross direction (CD) tensile, machine (MD) tensile, internal bond, wet tensile, hygroexpansivity, curl, bonding properties, bonding of joint tape to joint compound, etc. The paper product of the invention may be produced by contacting the plurality of cellulose fibers with each of the wet strength additive, alkaline sizing agent, and/or anionic promoter at any other point in the paper making process. Finally, the invention relates to methods of making and using the paper substrate.

BACKGROUND OF THE INVENTION

Wallboard (also known as drywall) has become the dominant material in the production of interior building partitions. In particular, interior building partitions generally comprise a studwall of spaced parallel vertical members (studs) which are used as a support for preformed panels (wallboard) which are attached to the studwall by screws, nails, adhesive or any other conventional attachment system. Obviously, joints exist between adjacent preformed panels. In order to provide a continuous flat surface to the wall, it is necessary to "finish" the joint between adjacent panels. Generally, such "finishing" may include the building up of multiple layers of a mastic material (joint compound) and the blending of this joint compound and paper substrate suitable for wallboard tape utility into the panel surface so as to form the desired flat and contiguous wall surface. In addition, wallboard tape may be used to bring together a plurality of panels forming a corner which may include but is not limited to corner bead.

In order to facilitate this finishing of the joints and/or corners, most manufacturers bevel the longitudinal edges of the wallboard panels so as to allow a build-up of mastic material which will then match the level of the major surface area of the preformed panel. Typically, the buildup of the mastic material in the joint area comprises the application of a first layer of mastic material, the embedding of a wallboard tape (for example a paper tape) in the first layer of mastic material and then the overcoating of the tape with one or more, generally two layers of additional mastic material. This finishing of the joints is a time consuming process, since it is generally necessary to wait 24 hours between each application of a coat of mastic material in order to allow the coat to dry before the application of an overcoat of an additional layer of mastic material. Moreover, it is then necessary generally to sand the joint area so as to produce a finish which will match the major portion of the surface area of the wallboard panels. The "finishing" process thus is both time-consuming and labor-intensive.

Wallboard tape paper is a very challenging paper to make as there is a very narrow window of operation in which to achieve the required high tensile strengths while maintaining other good physical properties such as bonding properties, bonding of joint tape to joint compound, hygroexpansivity, curl, etc. For example, conventional methods of making paper substrates suitable for use as wallboard tape require environments having pHs of less than 7.0 and/or "acidic" conditions. However, a growing number of environmental concerns are forcing paper substrate manufacturers to provide paper making environments having pH's of at least 7.0 and/or "basic" or "alkaline" conditions. The challenge to the next generation of wallboard tape paper substrate production is to program the very specific and stringent levels of physical properties such as CD tensile, MD tensile, internal bond, wet tensile, hygroexpansivity, curl, bonding properties, bond of joint tape to joint compound, etc (which are demanded by wallboard tape paper substrate converters and users) into an alkaline-based paper substrate itself prior to converting and/or use. Such levels of physical properties such as CD tensile, MD tensile, internal bond, wet tensile, hygroexpansivity, curl, bonding properties, bond of joint tape to joint compound, etc, have been achieved by conventional production of paper substrates under acidic conditions. Presently, a paper substrate made within alkaline environments and suitable for wallboard tape converting (e.g. have acceptable physical properties such as CD tensile, MD tensile, internal bond, wet tensile, hygroexpansivity, curl, bonding properties, bond of joint tape to joint compound, etc) has been difficult to achieve, limiting the supply chain of such paper substrates to only those few papermaking sources reserved for production of paper substrates under acidic conditions.

Despite the considerable efforts, there existed a need for a wallboard tape to satisfy the construction industries' requirements for an alkaline wallboard tape having highly sought after physical properties.

SUMMARY OF THE INVENTION

One object of the present invention is a paper substrate containing a plurality of cellulose fibers; a wet strength additive; an alkaline sizing agent; and optionally an anionic promoter. One aspect of the present invention is to provide a substrate having a pH of from 7.0 to 14.0. Further, another aspect of the present invention is to provide a substrate having an internal bond of from about 25 to about 350 milli ft-lb/sq. in. as measured by TAPPI method 541. An additional aspect of the present invention is a paper substrate having a basis weight of from 50 to 120 lbs/3000 sq. ft. A further aspect of the present invention is a paper substrate having an apparent density of from 5.0 to 20 lb/3000 sq. ft. per 0.001 inch thickness. A still further aspect of the present invention is a paper substrate having a MD Tensile of from 25 to 100 lbf/inch width. In addition, the paper substrate of the present invention may have a CD Tensile of from 5 to 50 lbf/inch width. Further, an aspect of the present invention is an abraded paper substrate. Still further, an aspect of the present invention is an abraded paper substrate or sanded and has a cut width of from 1.5 to 3.25 inches. The present invention also relates to methods of making and using the paper substrate, especially when such methods involve the production and use of the substrate as wallboard tape.

Another object of the present invention is a paper substrate having a pH of from 7.0 to 14.0 and containing a plurality of cellulose fibers; a wet strength additive; an alkaline sizing agent; and an anionic promoter. One aspect of the present invention is a paper substrate having a basis weight of from 50 to 120 lbs/3000 sq. ft. A further aspect of the present invention is a paper substrate having an apparent density of from 5.0 to 20 lb/3000 sq. ft. per 0.001 inch thickness. A still further aspect of the present invention is a paper substrate having a MD Tensile of from 25 to 100 lbf/inch width. In addition, the paper substrate of the present invention may have a CD Tensile of from 5 to 50 lbf/inch width. Further, an aspect of the present invention is an abraded paper substrate. Still further, an aspect of the present invention is an abraded paper substrate or sanded substrate and has a cut width of from 1.5 to 3.25 inches. The present invention also relates to methods of making and using the paper substrate, especially when such methods involve the production and use of the substrate as wallboard tape.

DETAILED DESCRIPTION OF THE INVENTION

Figure 1:
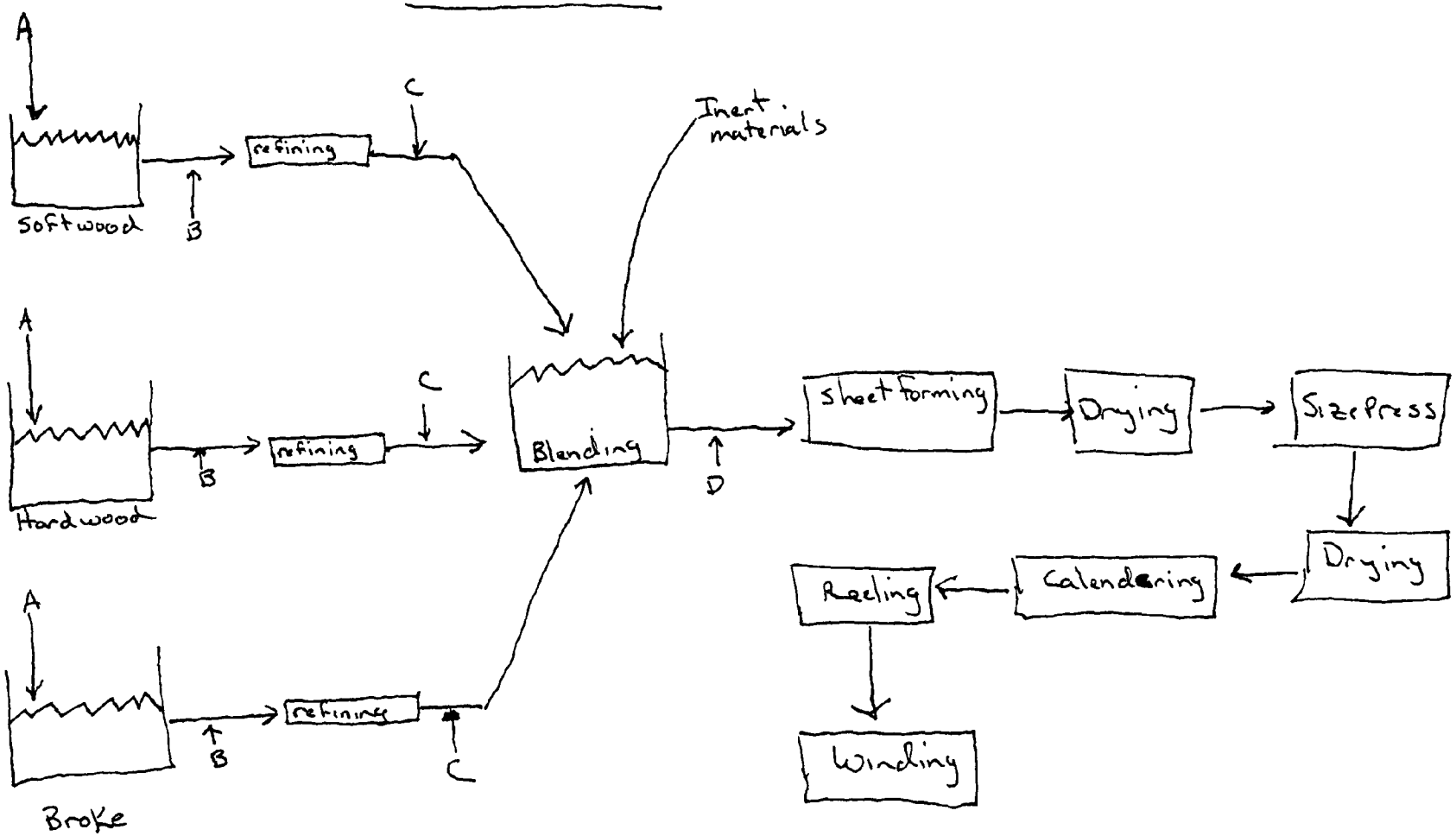
FIG. 1: A flow chart that demonstrates the preferred methodology of making the paper substrate of the present invention stressing the addition points of a wet strength additive, an alkaline sizing agent, and an anionic promoter. Wet strength additive, an alkaline sizing agent, and an anionic promoter are preferably added at a any and/or all addition points A, B, C, and/or D.

The present inventors have now discovered a paper substrate having a pH of at least 7.0 which, until now, was unable to meet the stringent physical properties required by the construction industries, as well as methods of making and using the same.

The paper substrate of the present invention may contain recycled fibers and/or virgin fibers. Recycled fibers differ from virgin fibers in that the fibers have gone through the drying process at least once.

The paper substrate of the present invention may contain from 1 to 99 wt % of cellulose fibers based upon the total weight of the substrate, including 1, 5, 10, 15, 20, 25, 30, 35, 40, 45, 50, 55, 60, 65, 70, 75, 80, 85, 90, 95 and 99 wt %, and including any and all ranges and subranges therein.

Preferably, the sources of the cellulose fibers are from softwood and/or hardwood. The paper substrate of the present invention may contain from 50 to 100 wt %, preferably from 80 to 95%, cellulose fibers originating from softwood species based upon the total amount of cellulose fibers in the paper substrate. This range includes 50, 55, 60, 65, 70, 75, 80, 85, 90, 95, and 100 wt %, including any and all ranges and subranges therein, based upon the total amount of cellulose fibers in the paper substrate.

The paper substrate of the present invention may contain from 0 to 50 wt %, preferably from 5 to 20%, cellulose fibers originating from hardwood species based upon the total amount of cellulose fibers in the paper substrate. This range includes 0, 5, 10, 15, 20, 25, 30, 35, 40, 45 and 50 wt %, including any and all ranges and subranges therein, based upon the total amount of cellulose fibers in the paper substrate.

Further, the softwood and/or hardwood fibers contained by the paper substrate of the present invention may be modified by physical and/or chemical means. Examples of physical means include, but is not limited to, electromagnetic and mechanical means. Means for electrical modification include, but are not limited to, means involving contacting the fibers with an electromagnetic energy source such as light and/or electrical current. Means for mechanical modification include, but are not limited to, means involving contacting an inanimate object with the fibers. Examples of such inanimate objects include those with sharp and/or dull edges. Such means also involve, for example, cutting, kneading, pounding, impaling, etc means.

Examples of chemical means include, but is not limited to, conventional chemical fiber modification means. Examples of such modification of fibers may be, but is not limited to, those found in the following U.S. Pat. Nos. 6,592,717, 6,582,557, 6,579,415, 6,579,414, 6,506,282, 6,471,824, 6,361,651, 6,146,494, H1,704, 5,698,688, 5,698,074, 5,667,637, 5,662,773, 5,531,728, 5,443,899, 5,360,420, 5,266,250, 5,209,953, 5,160,789, 5,049,235, 4,986,882, 4,496,427, 4,431,481, 4,174,417, 4,166,894, 4,075,136, and 4,022,965, which are hereby incorporated in their entirety by reference.

The paper substrate of the present invention may contain at least one wet strength additive. The wet strength additive may be cationic, anionic, neutral, and amphoteric. A preferred wet strength additive is cationic and/or contains a basic functional group. Examples of the wet strength additive may be, but is not limited to, polymeric amine epichlorohydrin (PAE), urea formaldehyde, melamine formaldehyde and glyoxylated polyacrylamide resins. Further examples of wet strength additives that may be incorporated in to the present invention may include, but is not limited to, those found in the following patents: U.S. Pat. Nos. 6,355,137 and 6,171,440, which are hereby incorporated in their entirety by reference. Preferred wet strength additives include, but are not limited to, polymeric amine epichlorohydrin (PAE).

The paper substrate of the present invention may contain from 0.25 to 2.5 wt % of the wet strength additive based upon the total weight of the substrate. This range includes 0.25, 0.30, 0.35, 0.40, 0.45, 0.50, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4 and 2.5 wt %, including any and all ranges and subranges therein.

The paper substrate of the present invention may contain at least one alkaline sizing agent. Examples of the alkaline sizing agent may be, but is not limited to, unsaturated hydrocarbon compounds, such as C6 to C24, preferably C18 to C20, unsaturated hydrocarbon compounds and mixtures thereof.

Further examples of alkaline sizing agents that may be incorporated in to the present invention may include, but is not limited to, those found in the following patents: U.S. Pat. Nos. 6,595,632, 6,512,146, 6,316,095, 6,273,997, 6,228,219, 6,165,321, 6,126,783, 6,033,526, 6,007,906, 5,766,417, 5,685,815, 5,527,430, 5,011,741, 4,710,422, and 4,184,914, which are hereby incorporated in their entirety by reference. Preferred alkaline sizing agent may be, but not limited to, alkyl ketene dimer, alkenyl ketene dimer and alkenyl succinic anhydride.

The paper substrate of the present invention may contain from 0.05 to 1.5 wt % of the alkaline sizing agent based upon the total weight of the substrate. This range includes 0.05, 0.06, 0.07, 0.08, 0.09, 0.1, 0.2, 0.3, 0.4, 0.5, 0.6, 0.7, 0.8, 0.9, 1.0, 1.1, 1.2, 1.3, 1.4, and 1.5 wt %, including any and all ranges and subranges therein.

The paper substrate of the present invention may contain at least one anionic promoter. Examples of the anionic promoter may be, but is not limited to, polyacrylates, sulfonates, carboxymethyl celluloses, galactomannan hemicelluloses and polyacrylamides. Preferred anionic promoters include, but are not limited to polyacrylates such as Nalco 64873.

The paper substrate of the present invention may contain from 0.05 to 1.5 wt % of the anionic promoter based upon the total weight of the substrate. This range includes 0.05, 0.06, 0.07, 0.08, 0.09, 0.1, 0.2, 0.3, 0.4, 0.5, 0.6, 0.7, 0.8, 0.9, 1.0, 1.1, 1.2, 1.3, 1.4, and 1.5 wt %, including any and all ranges and subranges therein.

The paper substrate of the present invention may have a MD tensile as measured by conventional TAPPI method 494 of from 25 to 100, preferably from 40 to 90 lbf/inch width. This range includes MD tensile of 25, 30, 35, 40, 45, 50, 55, 60, 65, 70, 75, 80, 85, 90, 95, and 100 lbf/inch width, including any and all ranges and subranges therein.

The paper substrate of the present invention may have a CD tensile as measured by conventional TAPPI method 494 of from 5 to 50, preferably from 20 to 50 lbf/inch width, most preferably 25 to 40 lbf/inch width. This range includes CD tensile of 5, 10, 15, 20, 25, 30, 35, 40, 45, and 50 lbf/inch width, including any and all ranges and subranges therein.

The paper substrate of the present invention may have a wet strength as measured by conventional TAPPI method 456 of from 5 to 50, preferably from 10 to 25, most preferably from 15 to 25, lb/inch width. This range includes wet strengths of 5, 10, 15, 20, 25, 30, 35, 40, 45, and 50 lb/inch width, including any and all ranges and subranges therein.

The paper substrate of the present invention may have an internal bond as measured by conventional TAPPI method 541 of from 25 to 350, preferably from 50 to 250, most preferably from 100-200, milli ft-lb/sq. in. This range includes internal bond of 25, 30, 35, 40, 45, 50, 55, 60, 65, 70, 75, 80, 85, 90, 95, 100, 110, 125, 150, 175, 200, 225, 250, 275, 300, 325 and 350 milli ft-lb/sq. in, including any and all ranges and subranges therein.

The paper substrate of the present invention may have a pH of at least about 7.0 as measured by any conventional method such as a pH marker/pen and conventional TAPPI methods 252 and 529 (hot extraction test and/or surface pH test). The pH of the paper may be from about 7.0 to 14.0, preferably about 7.0 to 9.0, most preferably from about 7.1 to 8.5. This range includes pHs of 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.2, 9.4, 9.5, 9.6, 9.8, 10.0, 10.5, 11.0, 11.5, 12.0, 12.5, 13.0, 13.5, and 14.0, including any and all ranges and subranges therein.

The paper substrate according to the present invention may be made off of the paper machine having a basis weight of from 50 lb/3000 sq. ft. to 120 lb/3000 sq. ft, preferably from 70 to 120, and most preferably from 80-100 lb/3000 sq. ft. The basis weight of the substrate may be 50, 52, 54, 55, 56, 58, 60, 62, 64, 65, 66, 68, 70, 72, 74, 75, 76, 78, 80, 82, 84, 85, 86, 88, 90, 92, 94, 95, 96, 98, 100, 105, 110, 115 and 120 lb/3000 sq. ft, including any and all ranges and subranges therein.

The paper substrate according to the present invention may be made off of the paper machine having an apparent density of from 5.0 to 20.0, preferably 9.0 to 13.0, most preferably from 9.5 to 11.5, lb/3000 sq. ft. per 0.001 inch thickness. The apparent density of the substrate may be 5.0, 5.2, 5.4, 5.5, 5.6, 5.8, 6.0, 6.2, 6.4, 6.5, 6.6, 6.8, 7.0, 7.2, 7.4, 7.5, 8.0, 8.5, 9.0, 9.5, 10.0, 10.5, 11.0, 11.5, 12.0, 12.5, 13.0, 13.5, 14.0, 14.5, 15.0, 15.5, 16.0, 16.5, 17.0, 17.5, 18.0, 18.5, 19.0, 19.5 and 20.0 lb/3000 sq. ft. per 0.001 inch thickness, including any and all ranges and subranges therein.

The paper substrate according to the present invention may have a width off the winder of a paper machine of from 5 to 100 inches and can vary in length. The width of the paper substrate may be 5, 10, 15, 20, 25, 30, 35, 40, 45, 50, 55, 60, 65, 70, 75, 80, 85, 90, 95, 100 inches, including any and all ranges and subranges therein.

Additionally, the paper substrate according to the present invention may be cut into streamers that have a width of from 1.5 to 3.25 inches wide and may vary in length. The width of the paper substrate streamer may have a width of 1.50, 1.60, 1.70, 1.75, 1.80, 1.85, 1.9, 1.95, 2.00, 2.10, 2.20, 2.30, 2.40, 2.50, 2.60, 2.70, 2.80, 2.90, 3.00, 3.05, 3.10, 3.15, 3.20, and 3.25 inches, including any and all ranges and subranges therein.

The paper substrate of the present invention may also include binders and inert substances including fillers, thickeners, and preservatives. Other inert substances include, but are not limited to silicas such as colloids and/or sols. Examples of silicas include, but are not limited to, sodium silicate and/or borosilicates. Another example of inert substances is solvents including but not limited to water. Examples of fillers include, but are not limited to; calcium carbonate, calcium sulfate hemihydrate, and calcium sulfate dehydrate. A preferable filler is calcium carbonate. Examples of binders include, but are not limited to, polyvinyl alcohol, Amres (a Kymene type), Bayer Parez, polychloride emulsion, modified starch such as hydroxyethyl starch, starch, polyacrylamide, modified polyacrylamide, polyol, polyol carbonyl adduct, ethanedial/polyol condensate, polyamide, epichlorohydrin, glyoxal, glyoxal urea, ethanedial, aliphatic polyisocyanate, isocyanate, 1,6 hexamethylene diisocyanate, diisocyanate, polyisocyanate, polyester, polyester resin, polyacrylate, polyacrylate resin, acrylate, and methacrylate.

The paper substrate of the present invention may contain from 0.001 to 20 wt % of the inert substances based on the total weight of the substrate, preferably from 0.01 to 10 wt %, most preferably 0.1 to 5.0 wt %, of each of at least one of the inert substances. This range includes 0.001, 0.002, 0.005, 0.006, 0.008, 0.01, 0.02, 0.03, 0.04, 0.05, 0.1, 0.2, 0.4, 0.5, 0.6, 0.7, 0.8, 0.9, 1, 2, 4, 5, 6, 8, 10, 12, 14, 15, 16, 18, and 20 wt % based on the total weight of the substrate, including any and all ranges and subranges therein.

The paper substrate of the present invention may also contain starch at a wt % of from 0.05 wt % to 20 wt % based on the total weight of the substrate. The wt % of starch contained by the substrate may be 0.05, 0.1, 0.2, 0.4, 0.5, 0.6, 0.7, 0.8, 0.9, 1, 2, 4, 5, 6, 8, 10, 12, 14, 15, 16, 18, and 20 wt % based on the total weight of the substrate, including any and all ranges and subranges therein.

The paper substrate may be made by contacting a plurality of cellulose fibers with a wet strength additive, an alkaline sizing agent, and an anionic promoter consecutively and/or simultaneously. Further, the contacting may occur in an aqueous environment having a pH of from 7.0 to 14.0. Still further, the contacting may occur at acceptable concentration levels that provide the paper substrate of the present invention to contain any of the above-mentioned amounts of cellulose fibers, wet strength additive, alkaline sizing agent, anionic promoter, filler, binder, thickener, and plasticizer isolated or in any combination thereof. The contacting may occur anytime in the papermaking process including, but not limited to the thick stock, thin stock, head box, size press, water box, and coater. The cellulose fibers, wet strength additive, alkaline sizing agent, anionic promoter may be contacted serially, consecutively, and/or simultaneously in any combination with each other. The cellulose fibers, wet strength additive, alkaline sizing agent, anionic promoter may be pre-mixed in any combination before addition to the paper-making process.

These methods of making the paper substrate of the present invention may be added to any conventional papermaking processes, as well as converting processes, including abrading, sanding, slitting, scoring, perforating, sparking, calendaring, sheet finishing, converting, coating, laminating, printing, etc. Preferred conventional processes include those tailored to produce paper substrates capable to be utilized as wallboard tape. Textbooks such as those described in the "Handbook for pulp and paper technologists" by G. A. Smook (1992), Angus Wilde Publications, describe such processes and is hereby incorporated, in its entirety, by reference.

The present invention is explained in more detail with the aid of the following embodiment example which is not intended to limit the scope of the present invention in any manner.

EXAMPLES

Example 1

Method

A method of making the product of the present invention is depicted in FIG. 1. FIG. 1 demonstrates a flow diagram of a specific papermaking process incorporating the serial and/or simultaneous addition of a wet strength additive, an alkaline sizing agent, an anionic promoter with a plurality of softwood and hardwood cellulose fibers at any one or more entry points selected from A, B, C, and/or D. The resultant paper substrate is summarized in Table 1. The papermaking process utilized the following stations of: pulp chest, refining, blending, sheet forming, drying, pressing, size press treatment, drying, calendaring, reeling, and winding. This can be followed by any conventional converting methods to produce, preferably, a wallboard tape.

TABLE 1

Paper substrate product made from the process summarized above and in FIG. 1

| Ingredient | Wt % based in the total weight of the paper substrate |
|---|---|
| Alkaline Sizing Agent | 0.1% |
| Wet Strength Additive | 1% |
| Anionic Promoter | 0.25% |
| Inert substances | 8.65% |
| Cellulosic Fibers | 90% (of which 90% Softwood and 10% Hardwood based on total weight of Cellulosic Fibers) |

As used throughout, ranges are used as a short hand for describing each and every value that is within the range, including all subranges therein.

Numerous modifications and variations on the present invention are possible in light of the above teachings. It is, therefore, to be understood that within the scope of the accompanying claims, the invention may be practiced otherwise than as specifically described herein.

All of the references, as well as their cited references, cited herein are hereby incorporated by reference with respect to relative portions related to the subject matter of the present invention and all of its embodiment

What is claimed is:

1. A paper product comprising a paper substrate made into wallboard tape, wherein the paper substrate comprises:

a plurality of cellulose fibers;

a cationic wet strength additive in an amount of from 0.25 to 2.5 wt % based on the total weight of the paper substrate;

an alkaline sizing agent in an amount of from 0.05 to 1.5 wt % based on the total weight of the paper substrate; and an anionic promoter which is at least one member selected from the group consisting of a polyacrylate, sulfonate, carboxymethyl cellulose, and galactomannan hemicellulose in an amount of from 0.05 to 1.5 wt % based on the total weight of the paper substrate, wherein the paper substrate has:

a pH of from about 7.0 to about 10.0; and an internal bond of from about 25 to about 350 milli ft-lb/sq. in. as measured by TAPPI method 541.

2. The paper product according to claim 1, wherein the paper substrate has a basis weight of from 50 to 120 lbs/3000 sq. ft.

3. The paper product according to claim 1, wherein the paper substrate has an apparent density of from 5.0 to 20 lb/3000 sq. ft. per 0.001 inch thickness.

4. The paper product according to claim 1, wherein the paper substrate has a MD Tensile of from 25 to 100 lbf/inch width.

5. The paper product according to claim 1, wherein the paper substrate has a CD Tensile of from 5 to 50 lbf/inch width.

6. The paper product according to claim 1, wherein at least a majority of the plurality of cellulose fibers is softwood fibers.

7. The paper product according to claim 1, wherein the paper substrate further comprises calcium carbonate.

8. The paper product according to claim 1, wherein the alkaline sizing agent is at least one member selected from the group consisting of alkyl ketene dimer, alkenyl ketene dimer and alkenyl succinic anhydride.

9. The paper product according to claim 1, wherein the paper substrate further comprises at least one member selected from the group consisting of a binder, filler, thickener, and preservative.

10. The paper product according to claim 1, wherein at least one surface of the paper substrate is an abraded surface.

11. The paper product according to claim 1, wherein at least one surface of the paper substrate is a sanded surface.

12. The paper product according to claim 1, wherein the paper substrate has a width off a winder of a paper machine of from 15 to 100 inches.

13. The paper product according to claim 1, wherein the paper substrate is abraded or sanded and has a cut width of from 1.5 to 3.25 inches.

14. The paper product according to claim 1, wherein the wet strength agent is at least one member or combinations selected from the group consisting of a polymeric amine epichlorohydrin, urea formaldehyde, melamine formaldehyde and glyoxylated polyacrylamide resins.

15. The paper product according to claim 1, wherein the paper substrate further comprises calcium carbonate in at least one form selected from the group consisting of precipitated calcium carbonate and ground calcium carbonate.

16. The paper product according to claim 1, wherein the alkaline sizing agent is at least one unsaturated hydrocarbon having from 16 to 20 carbon atoms.

17. The paper product according to claim 1, wherein the paper substrate further comprises a binder.

18. The paper product according to claim 1, wherein the anionic promoter is a polyacrylate.

19. A method of making the paper product substrate according to claim 1, comprising contacting a plurality of cellulose fibers with a wet strength additive, an alkaline sizing agent, and an anionic promoter consecutively and/or simultaneously.

20. The method according to claim 19, wherein the plurality of cellulose fibers is contacted with:

from 0.25 to 1 wt % of wet strength additive based upon the total weight of the paper substrate;

from 0.05 to 0.2 wt % of alkaline sizing agent based upon the total weight of the paper substrate; and from 0.05 to 0.2 wt % of anionic promoter based upon the total weight of the paper substrate.

21. The method according to claim 19, wherein the paper substrate has an internal bond of from about 70 to about 200 milli ft-lb/sq. in.; a CD Tensile of from 15 to 40 lbf/inch width, and a MD Tensile of from 40 to 80 lbf/inch width.

22. The method according to claim 19, further comprising sanding or abrading at least one surface of the paper substrate after said contacting.

* * * * *